US010024065B2

(12) United States Patent
Balmer et al.

(10) Patent No.: US 10,024,065 B2
(45) Date of Patent: Jul. 17, 2018

(54) FLOOR PANEL AND FLOATING FLOOR SYSTEM INCORPORATING THE SAME

(75) Inventors: Richard H. Balmer, Manheim, PA (US); John R. Eshbach, Jr., Marietta, PA (US); Kean M. Anspach, Quarryville, PA (US); Heath Harrington, Columbia, PA (US); Michael E. Buckwalter, New Providence, PA (US); Brent L. Stoll, Litiz, PA (US)

(73) Assignee: AFI Licensing LLC, Lancaster, PA (US)

( * ) Notice: Subject to any disclaimer, the term of this patent is extended or adjusted under 35 U.S.C. 154(b) by 830 days.

(21) Appl. No.: 12/412,419

(22) Filed: Mar. 27, 2009

(65) Prior Publication Data

US 2010/0247834 A1 Sep. 30, 2010

(51) Int. Cl.
*B32B 33/00* (2006.01)
*E04F 15/10* (2006.01)

(52) U.S. Cl.
CPC ..... *E04F 15/105* (2013.01); *E04F 15/107* (2013.01); *E04F 2201/0138* (2013.01); *E04F 2201/07* (2013.01); *E04F 2203/065* (2013.01); *E04F 2290/043* (2013.01); *Y10T 428/1476* (2015.01); *Y10T 428/24802* (2015.01)

(58) Field of Classification Search
None
See application file for complete search history.

(56) References Cited

U.S. PATENT DOCUMENTS 2,737,693 A * 3/1956 Robbins ..... 52/578
2,914,815 A 12/1959 Alexander
3,270,473 A 9/1966 Smith
3,866,267 A 2/1975 Poletti
3,902,293 A 9/1975 Witt et al.
3,988,187 A 10/1976 Witt et al.
4,242,390 A * 12/1980 Nemeth ..... 428/47
(Continued)

FOREIGN PATENT DOCUMENTS

AU 2006201915 B1 5/2007
AU 2006252200 B2 7/2007
(Continued)

OTHER PUBLICATIONS

Lowe's Home Centers, Inc.'s Surface Source point-of-sale materials.

(Continued)

*Primary Examiner* — Cheng Huang

(57) ABSTRACT

A floor panel and a floating floor system incorporating the floor panel include a floor panel having a top layer and a bottom layer. The top layer has a top surface and a bottom surface. The top surface has a visible decorative pattern. The bottom layer has a top surface and a bottom surface. The top surface of the bottom layer is adhered to the bottom surface of the top layer such that the bottom layer is offset from the top layer in a direction of length and width and a marginal end portion of the top surface of the bottom layer and a marginal end portion of the bottom surface of the top layer is exposed. At least one of the marginal end portions has an adhesive, and a ratio of a thickness of the top layer to a thickness of the bottom layer is about 5 or greater.

39 Claims, 9 Drawing Sheets

(56) References Cited

U.S. PATENT DOCUMENTS

| | | | | |
|---|---|---|---|---|
| 4,489,115 | A | 12/1984 | Layman et al. | |
| 4,649,069 | A | 3/1987 | Tone | |
| 4,766,022 | A | 8/1988 | Tone | |
| 4,804,569 | A * | 2/1989 | Arisawa | 428/47 |
| 5,045,389 | A | 9/1991 | Campagna | |
| 5,382,462 | A | 1/1995 | Pacione | |
| 5,750,227 | A * | 5/1998 | Adams | 428/42.2 |
| 5,894,700 | A * | 4/1999 | Sweet | 52/391 |
| 6,298,624 | B1 | 10/2001 | Pacione | |
| 6,306,477 | B1 | 10/2001 | Pacione | |
| 6,395,362 | B1 | 5/2002 | Pacione | |
| 6,460,303 | B1 | 10/2002 | Pacione | |
| 6,751,917 | B2 | 6/2004 | Mao | |
| 6,797,353 | B1 | 9/2004 | Pacione | |
| 6,802,167 | B2 | 10/2004 | Pacione | |
| 7,155,871 | B1 | 1/2007 | Stone et al. | |
| 7,185,465 | B2 | 3/2007 | Pacione | |
| 7,185,473 | B2 | 3/2007 | Pacione | |
| 7,194,843 | B2 | 3/2007 | Pacione | |
| 7,322,159 | B2 | 1/2008 | Stone et al. | |
| 7,383,663 | B2 | 6/2008 | Pacione | |
| 7,412,806 | B2 | 8/2008 | Pacione et al. | |
| 7,458,191 | B2 | 12/2008 | Stone | |
| 2001/0021431 | A1 * | 9/2001 | Chen et al. | 428/54 |
| 2005/0076606 | A1 * | 4/2005 | Curtis | 52/741.1 |
| 2006/0185303 | A1 | 8/2006 | Pacione et al. | |
| 2007/0079572 | A1 | 4/2007 | Pacione | |
| 2007/0204428 | A1 | 9/2007 | Pacione | |
| 2007/0204556 | A1 | 9/2007 | Pacione | |
| 2008/0172968 | A1 | 7/2008 | Pacione | |
| 2008/0289277 | A1 | 11/2008 | Stone | |
| 2009/0031657 | A1 | 2/2009 | Pacione | |
| 2009/0038251 | A1 | 2/2009 | Pacione | |

FOREIGN PATENT DOCUMENTS

| | | | |
|---|---|---|---|
| CA | 2260073 | C | 1/1998 |
| CA | 2513973 | A1 | 8/2004 |
| CA | 2568978 | | 2/2009 |
| DE | 10055354 | | 5/2002 |
| JP | 61-032416 | | 2/1986 |
| JP | 2007182750 | A | 7/2007 |
| JP | 2007182751 | A | 7/2007 |

OTHER PUBLICATIONS

Supplemental European Search Report dated Sep. 4, 2013, for corresponding EP Application No. 10756447.8 filed Oct. 27, 2011. EP.

* cited by examiner

FLOOR PANEL AND FLOATING FLOOR SYSTEM INCORPORATING THE SAME

FIELD OF THE INVENTION

The present invention relates to a floor panel comprising a top layer and a bottom layer adhered together in an offset relationship such that a marginal end portion of a top surface of the bottom layer and a marginal end portion of a bottom surface of the top layer are exposed wherein at least one of the marginal end portions has an adhesive, and a ratio of a thickness of the top layer to a thickness of the bottom layer is about 5 or greater. The present invention further relates to a floating floor system incorporating the same.

BACKGROUND OF THE INVENTION

Floor panels for use in floating floor systems typically comprise a top layer and a bottom layer adhered together in an offset relationship such that a substantially L-shaped marginal end portion of a top surface of the bottom layer and a substantially L-shaped marginal end portion of a bottom surface of the top layer are exposed. The top layer typically comprises at least one mix layer, a print film, a wear layer, and a top coat. The bottom layer typically comprises at least one mix layer. The bottom layer has a thickness about equal to or greater than the top layer. A ratio of a thickness of the top layer to a thickness of the bottom layer is typically in the range of about 2 or less. For example, the SURFACE SOURCE product sold by Lowe's Home Centers, Inc. has a top layer with a thickness of about 64 mils (about 1.63 millimeters), and a bottom layer with a thickness of about 61 mils (about 1.55 millimeters). Thus, the ratio of the thickness of the top layer to the bottom layer is about 1.05 (64 mils/61 mils=1.05).

In order to assemble the floating floor system, at least one of the marginal end portions of each of the floor panels is provided with an adhesive. The marginal end portion provided with the adhesive is engaged with the marginal end portion of an adjacent floor panel to form the floating floor system. The floor panels may be formed, for example, such that when the floating floor system is assembled on a sub-floor ends of the top layers of the adjacent floor panels substantially abut, while ends of the bottom layers of the adjacent floor panels are spaced apart a desired distance so that a gap is formed there between. Alternatively, the floor panels may be formed, for example, such that when the floating floor system is assembled on the sub-floor the ends of the top layers of the adjacent floor panels substantially abut and the ends of the bottom layers of the adjacent floor panels substantially abut.

Because the thickness of the bottom layer is significantly large (about 98 mils (about 2.5 millimeters)), when the floor panels are assembled such that a gap is formed between the ends of the bottom layers of the adjacent floor panels, the gap can telescope through the floor panels thereby significantly altering the aesthetic and structural characteristics of the top layer. For example, the gaps may cause buckling at a top surface of the top layer. Alternatively, when the floor panels are assembled such that the ends of the bottom layers of the adjacent floor panels substantially abut, unwanted gaps or overlapping can occur between the ends of the bottom layers due to deviations in the size of the marginal end portions and/or errors occurring during installation. These unwanted gaps or overlaps can additionally telescope through the floor panel thereby also significantly altering the aesthetic and structural characteristics of the top layer.

Additionally, the marginal end portions of the top layer of a first row of the floor panels, which are typically positioned adjacent a wall, remain unsupported when the floating floor system is assembled, because the marginal end portions of the top layer of the first row of the floor panels will not engage with an adjacent floor panel. Thus, because the thickness of the bottom layer is significantly large, the gap occurring between the sub-floor and the marginal end portion of the top layer will also negatively impact the aesthetic and structural characteristics of the top layer. For example, buckling at the top surface of the top layer can occur. Also, because the bottom layer and the top layer comprise mix layers, which contain fillers, the bottom layer and the top layer are prone to absorb moisture thereby further affecting the aesthetic and structural characteristics of the floor panels. This is particularly problematic, since the bottom layer is installed directly on a sub-floor.

Still further, because the bottom layer has a thickness greater than the top layer, when the floor panels are stacked, for example, during shipping, a space exists between the marginal end portions of the top layer of the adjacent flooring panels equal to the thickness of the bottom layer. Thus, during shipping, the unsupported marginal end portions of the top layer are prone to bend and/or curl an amount equal to the thickness of the bottom layer. Because of the structural characteristics of the top layer, these bends and/or curls remain in the marginal end portions of the top layer during installation and can thereby significantly alter the aesthetic and structural characteristics of the floor panel. For example, buckling can occur at the top surface of the top layer and/or the bond strength between the marginal end portions of the adjacent floor panels could be negatively affected.

BRIEF SUMMARY OF THE INVENTION

The invention relates to a floor panel comprising a top layer and a bottom layer. The top layer has a top surface and a bottom surface. The top surface has a visible decorative pattern. The bottom layer has a top surface and a bottom surface. The top surface of the bottom layer is adhered to the bottom surface of the top layer such that the bottom layer is offset from the top layer in a direction of length and width and a marginal end portion of the top surface of the bottom layer and a marginal end portion of the bottom surface of the top layer is exposed. At least one of the marginal end portions has an adhesive, and a ratio of a thickness of the top layer to a thickness of the bottom layer is about 5 or greater.

The invention further relates to a floating floor system comprising at least two adjacent floor panels. Each of the floor panels comprises a top layer and a bottom layer. The top layer has a top surface and a bottom surface. The top surface has a visible decorative pattern. The bottom layer has a top surface and a bottom surface. The top surface of the bottom layer is adhered to the bottom surface of the top layer such that the bottom layer is offset from the top layer in a direction of length and width and a marginal end portion of the top surface of the bottom layer and a marginal end portion of the bottom surface of the top layer is exposed. At least one of the marginal end portions has an adhesive, and a ratio of a thickness of the top layer to a thickness of the bottom layer is about 5 or greater. The marginal end portion of the top surface of the bottom layer is engaged with the marginal end portion of the bottom surface of the top layer of the adjacent floor panel.

DETAILED DESCRIPTION OF THE EMBODIMENT(S)

Figure 1:
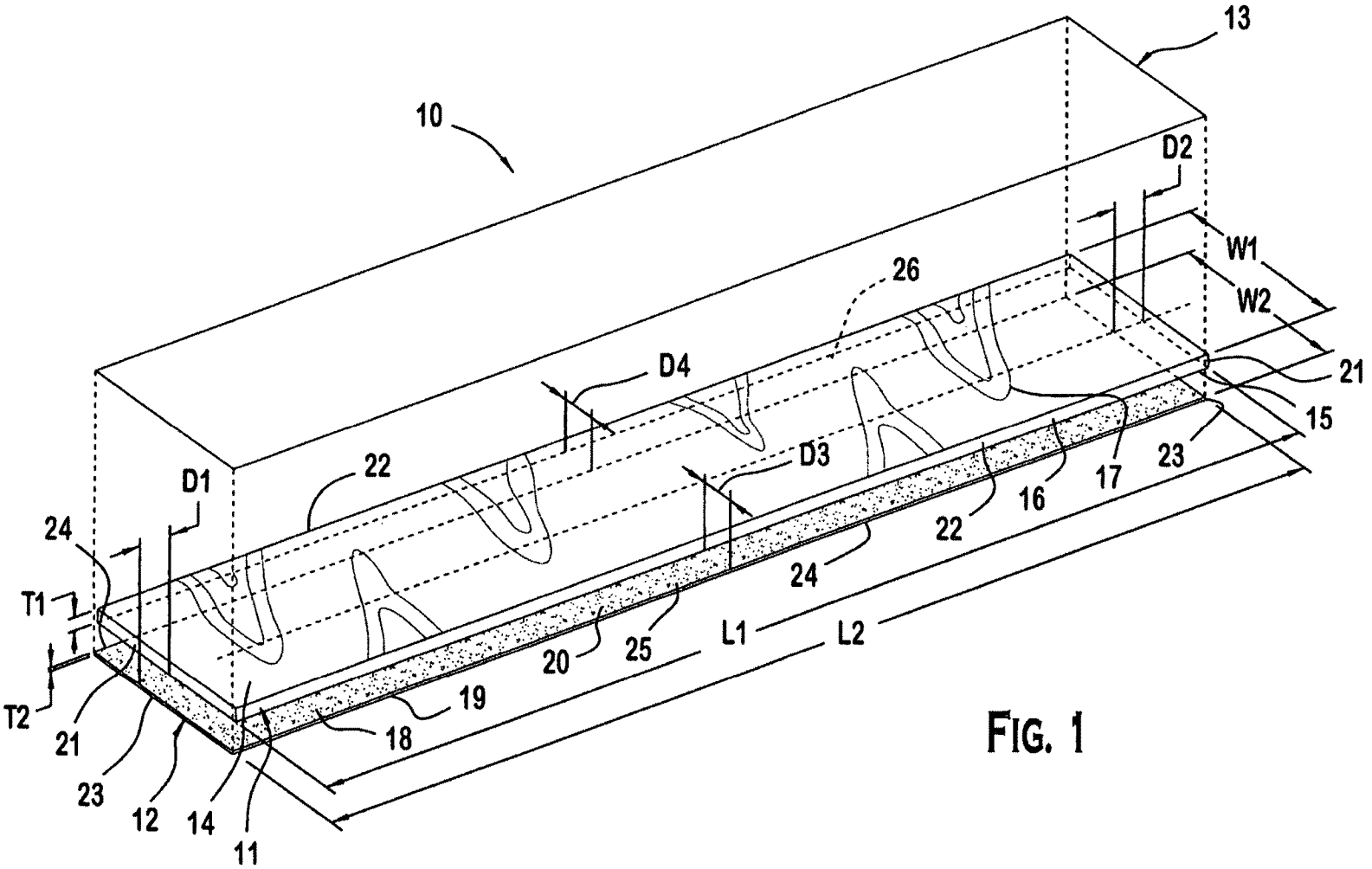
FIG. 1 is a partially exploded perspective view of a floor panel according to a first embodiment of the invention.
Figure 2:
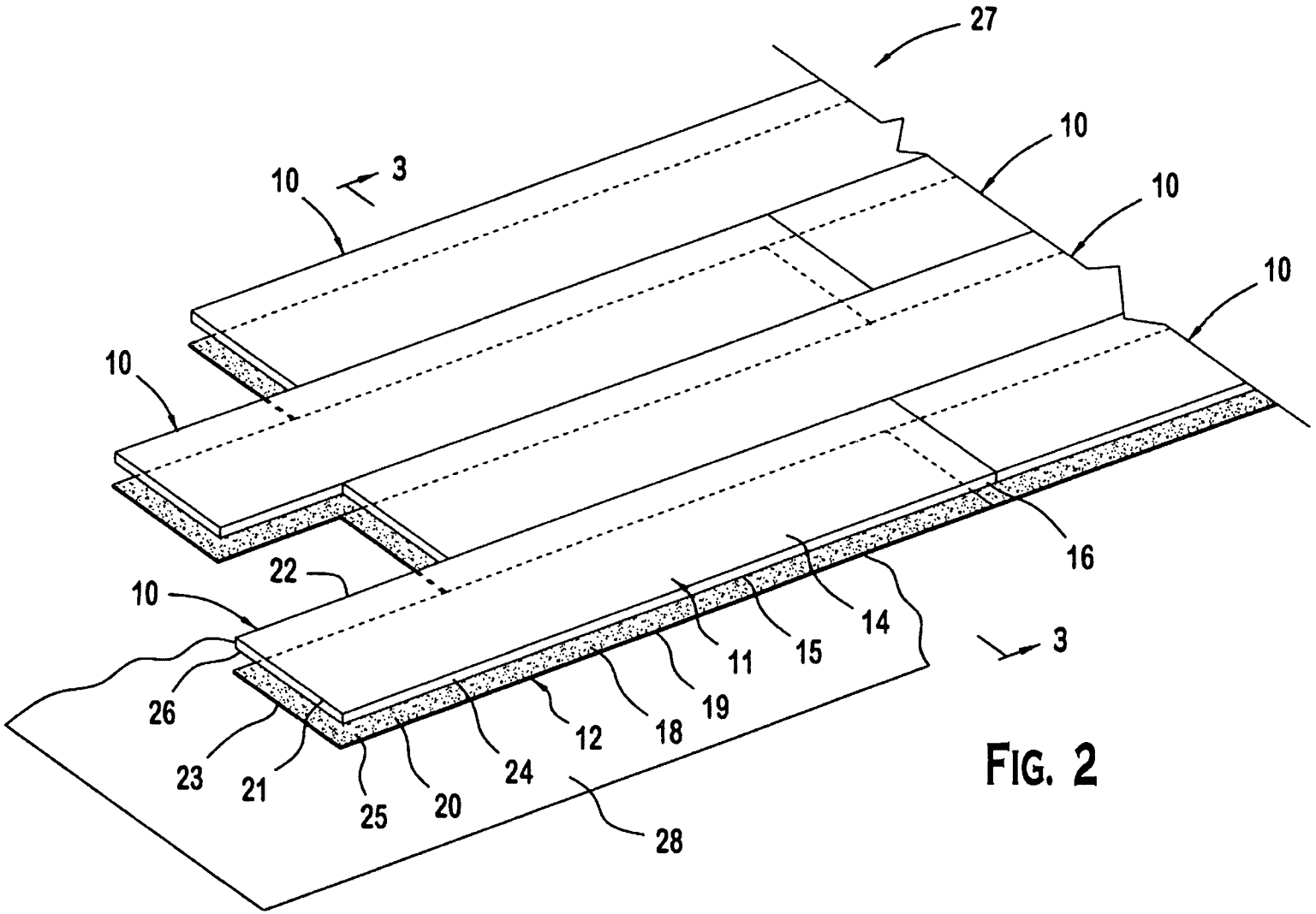
FIG. 2 is a perspective view of a floating floor system incorporating the floor panel of FIG. 1.
Figure 3:
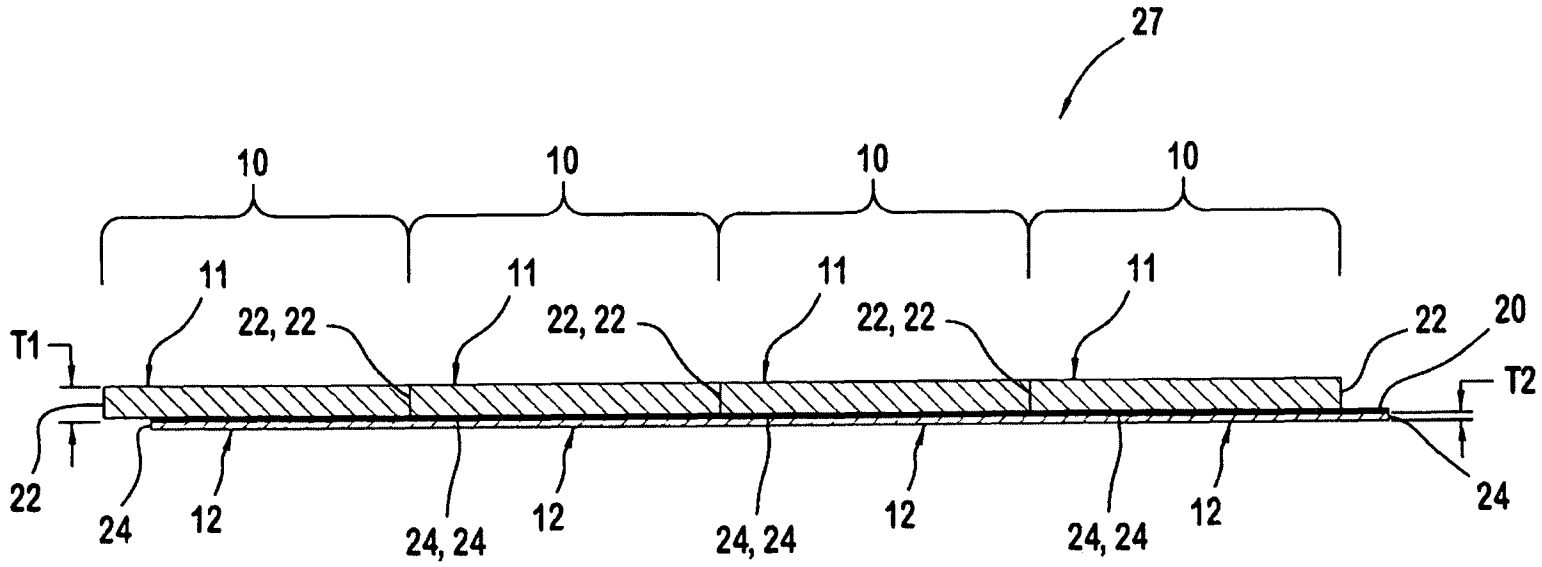
FIG. 3 is a sectional view taken along line 3-3 of FIG. 2.

FIGS. 1-3 show a floor panel 10 according to a first embodiment of the invention. As shown in FIG. 1, the floor panel 10 comprises a top layer 11, a bottom layer 12, and a release member 13. The top layer 11 may be formed, for example, from a substantially flexible sheet material, such as plastic, vinyl, polyvinyl chloride, polyester, or combinations thereof. The top layer 11 has a top surface 14 with a visible decorative pattern 17 and a bottom surface 15. In the illustrated embodiment, the top layer 11 comprises at least one mix layer 16, a print film provided with the visible decorative pattern 17, a wear layer (not shown), and a top coat (not shown), respectively. It will be appreciated by those skilled in the art that although the top layer 11 is shown and described herein as comprising multiple layers that the top layer 11 may alternatively comprise a single layer. Additionally, the types of layers constituting the top layer 11 and the visible decorative pattern 17 could be varied depending on the desired characteristics of the top layer 11.

As shown in FIG. 1, the top layer 11 has a thickness T1 of about 20-200 mils (about 0.508-5.08 millimeters), preferably about 60-180 mils (about 1.524-4.572 millimeters), and more preferably about 80-150 mils (about 2.032-3.810 millimeters). In the illustrated embodiment, the top layer 11 is substantially rectangular in shape and has a length L1 of about 36 inches (about 91.4 centimeters) and a width W1 of about 6 inches (about 15.2 centimeters). However, it will be appreciated by those skilled in the art that the geometrical shape and the length L1 and the width W1 of the top layer 11 may be varied depending on the desired dimension and geometrical configuration of the floor panel 10. For example, the top layer 11 may alternatively have a substantially square shape.

As shown in FIG. 1, the bottom layer 12 has a top surface 18 and a bottom surface 19. The bottom layer 12 may be formed, for example, from a film or tape comprising plastic, vinyl, polyvinyl chloride, polyester, polyolefin, nylon, or combinations thereof. The bottom layer 12 may also include recycle material, such as post industrial or post consumer scrap. The film or tape may be rigid or flexible and is preferably moisture resistant or waterproof. Additionally, the film or tape may be capable of being delivered or shipped in a roll. In the illustrated embodiment, the bottom layer 12 comprises a single layer of rigid black polyvinyl chloride film. Alternatively, the bottom layer 12 could comprise multiple layers, such as two layers of film laminated with a mat, such as a glass mat or polyethylene terephthalate mat, there between. The bottom layer 12 could also be provided with at least one of a continuous or discontinuous ink layer, antimicrobial layer, sound deadening layer, cushioning layer, slide resistant layer, stiffening layer, channeling layer, mechanically embossed texture, or chemical texture.

As shown in FIG. 1, the bottom layer 12 has a thickness T2 less than the thickness T1 of the top layer 11. A ratio of the thickness T1 of the top layer 11 to the thickness T2 of the bottom layer 12 is about 5 or greater, preferably about 10-100, and more preferably about 10-25. The bottom layer 12 has a length L2 and a width W2 the same as the length L1 and the width W1 of the top layer 11. Thus, in the illustrated embodiment, the bottom layer 12 is substantially rectangular in shape and has the length L2 of about 36 inches (about 91.4 centimeters) and the width W2 of about 6 inches (about 15.2 centimeters). However, it will be appreciated by those skilled in the art that the geometrical shape and the length L1 and the width W1 of the bottom layer 12 may be varied depending on the desired dimension and geometrical configuration of the floor panel 10. For example, the bottom layer 12 may alternatively have a substantially square shape.

As shown in FIG. 1, the bottom surface 15 of the top layer 11 is laminated to the top surface 18 of the bottom layer 12 by an adhesive 20. The adhesive 20 may be, for example, any suitable adhesive, such as a hot melt adhesive, a pressure sensitive adhesive, or a structural and/or reactive adhesive. In the illustrated embodiment, the adhesive is a pressure sensitive acrylic adhesive. The adhesive 20 may have, for example, a bond strength of at least 25 force-pounds, and more preferably about 25-30 force-pounds after having been heat aged for about 24 hours at 145 degrees Fahrenheit. In the illustrated embodiment, the adhesive 20 is provided on substantially an entirety of the top surface 18 of the bottom layer 12. The adhesive 20 may be applied to have a thickness, for example, of about 1-2 mils (about 0.0254-0.0508 millimeters). It will be appreciated by those skilled in the art, however, that the thickness of the adhesive 20 may vary depending on the texture of the bottom surface 15 of the top layer 11 and the texture of the top surface 18 of the bottom layer 12 in that a substantially smooth surface would require less of the adhesive 20 due to better adhesion and bond strength.

The top layer 11 is adhered to the bottom layer 12 so that the top layer 11 is offset from the bottom layer 12 in a direction of the length L1, L2 and the width W1, W2. In other words, opposing first ends 21 of the top layer 11 are offset in the direction of the length L1, L2 from opposing first ends 23 of the bottom layer 12 an offset distance D1, D2 and opposing second ends 22 of the top layer 11 are offset in the direction of the width W1, W2 from opposing second ends 24 of the bottom layer 12 an offset distance D3, D4. The offset distances D1, D2, D3, D4 are substantially the same. In the illustrated embodiment, the offset distances D1, D2, D3, D4 are, for example, about 1 inch (about 2.5 centimeters). Because the adhesive 20 is provided on substantially the entirety of the top surface 18 of the bottom layer 12, due to the offset of the top layer 11 relative to the bottom layer 12, a substantially L-shaped marginal end portion of the top surface 18 of the bottom layer 12 remains exposed to form an adhesive surface 25, and a substantially L-shaped marginal end portion of the bottom surface 15 of the top layer 11 remains exposed to form an attachment surface 26.

It will be appreciated by those skilled in the art that the adhesive 20 may also be provided on the marginal end portion of the bottom surface 15 of the top layer 11 instead of or in addition to the top surface 18 of the bottom layer 12 depending on the type and characteristics of the adhesive 20 used to achieve optimum adhesion and bond strength when adhering the adjacent floor panels 10, as described in more detail below with reference to FIGS. 2-3. Further, the adhesive 20 used to adhere the top layer 11 to the bottom layer 12 may be different from the adhesive 20 provided on the marginal end portions of the top layer 11 and and/or the bottom layer 12.

As shown in FIG. 1, the release member 13 is positioned adjacent to the top surface 14 of the top layer 11 and the adhesive surface 25 to cover the adhesive surface 25 during shipping of the floor panel 10 and prior to the installation thereof. In the illustrated embodiment, the release member 13 is a flexible sheet corresponding in size and shape to the bottom layer 12. It will be appreciated by those skilled in the art, however, that the size and shape of the release member 13 may be varied, as long as the release member 13 adequately covers the adhesive surface 25. The release member 13 may be made, for example, from any known suitable release material, such as a poly or silicone coated paper, a plastic sheet, a polymer film, or other material that enables the release member 13 to be quickly and easily removed from the adhesive surface 25 during the installation of the floor panel 10.

FIGS. 2-3 show a floating floor system 27 comprising a plurality of the floor panels 10 installed on a sub-floor 28. As shown in FIG. 2, in order to install the floor panels 10, at least one of the floor panels 10 is arranged on the sub-floor 28 such that the bottom surface 19 of the bottom layer 12 is in contact with the sub-floor 28. Preferably, the installation of the floor panels 10 should start adjacent a wall and/or in a corner of a room (not shown) and proceed outwardly there from. The release member 13 is removed from the floor panel 10 to expose the adhesive surface 25 on the top surface 18 of the bottom layer 12. Another one of the floor panels 10 is then adhered to the adhesive surface 25 by engaging the attachment surface 26 on the bottom surface 15 of the top layer 11 with the adhesive surface 25.

As shown in FIGS. 2-3, the floor panels 10 are installed such that the first ends 21, 23 of the top and bottom layers 11, 12 of the floor panels 10 substantially abut the first ends 21, 23 of the top and bottom layers 11, 12 of the adjacent floor panels 10, and the second ends 22, 24 of the top and bottom layers 11, 12 of the floor panels 10 substantially abut the second ends 22, 24 of the top and bottom layers 11, 12 of the adjacent floor panels 10. The process is repeated until the desired number of the floor panels 10 covers the sub-floor 28. Because the bottom layer 12 is yieldable to surface irregularities of the sub-floor 28, the floor panel 10 will conform to any surface irregularities in the sub-floor 28 and will therefore lie substantially flat on the sub-floor 28. The floor panels 10 can thereby be installed on the sub-floor 28 without any bonding material or adhesive being applied to the sub-floor 28. Additionally, because of the nature of the adhesive 20, particularly when the adhesive is a pressure sensitive adhesive, the floor panels 10 are capable of being easily detached from one another without damaging the floor panels 10 for ease of installation and/or replacement thereof. It will be appreciated by those skilled in the art that the pattern of the floor panels 10 shown in FIG. 2 is just one of numerous possible patterns for installing the floor panels 10 and that the installation of the floor panels 10 is not limited thereto.

Because the thickness T2 of the bottom layer 12 of the floor panels 10 is significantly less than the thickness T1 of the top layer 11, when the adjacent floor panels 10 are engaged, any unwanted gaps or overlapping that may occur between the first and second ends 22, 23 of the bottom layers 12 of the adjacent floor panels 10 due to deviations in the size of the marginal end portions and/or errors occurring during installation will not impact the aesthetic and/or structural characteristics of the top layer 11. Also, the size of any gaps occurring between the sub-floor 28 and the unsupported marginal end portions of the top layer 11 of a first row of the floor panels 10 is reduced. Therefore, by reducing the thickness of the bottom layer 12, buckling at the top surface 18 of the top layer 11 can be prevented. Additionally, because the bottom layer 12 does not comprise a mix layer and is formed of a moisture resistant material, the bottom layer 12 is capable of acting as a moisture barrier between the sub-floor 28 and the floor panel 10. Further, because the thickness T2 of the bottom layer 12 is smaller than the thickness T1 of the top layer 11, when the floor panels 10 are stacked, for example, during shipping, the distance between the unsupported marginal end portions of the adjacent top layers 11 is decreased such that any bending and/or curling of the unsupported marginal end portions of the top layers 11 is reduced.

Figure 4:
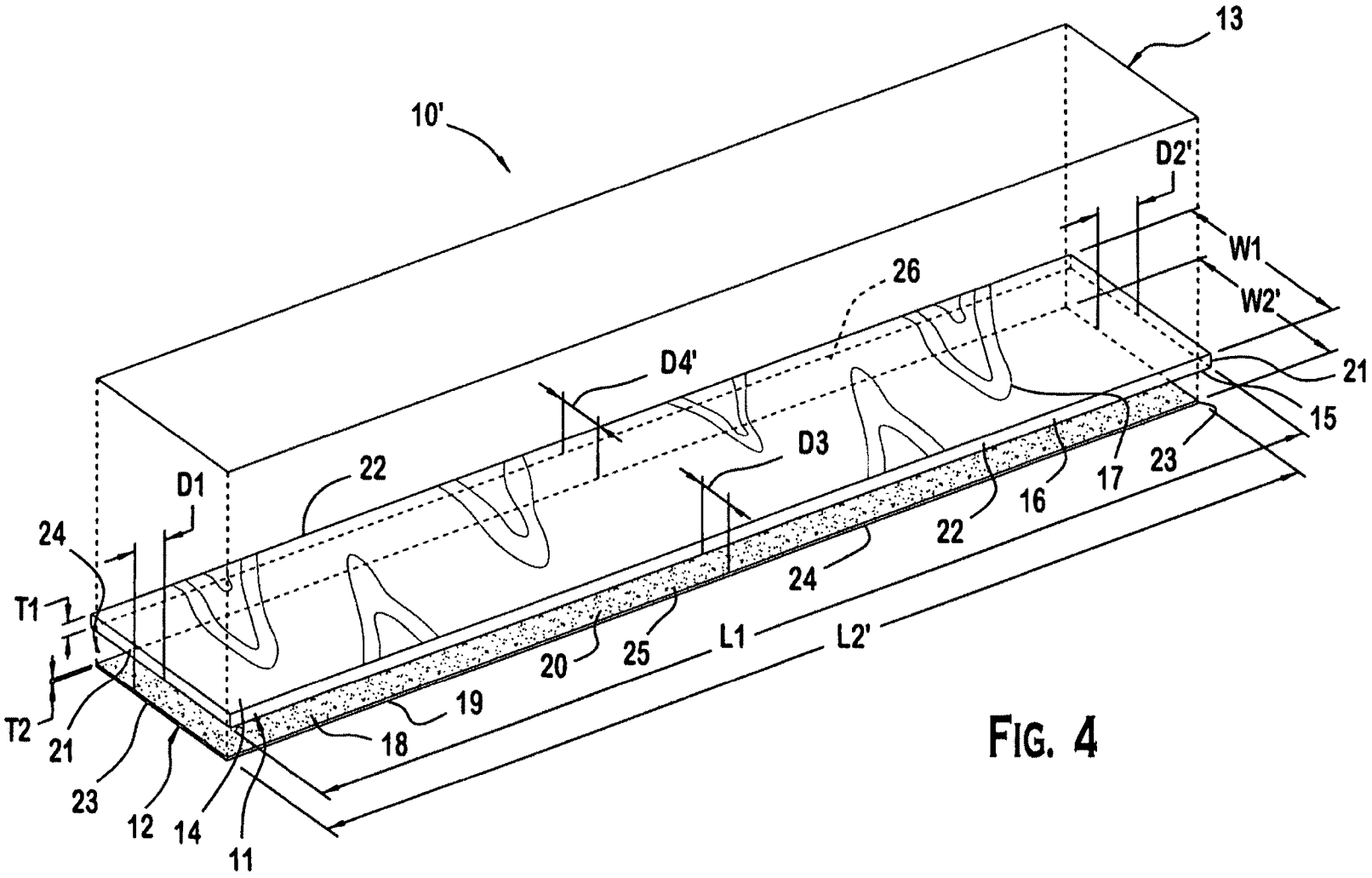
FIG. 4 is a partially exploded perspective view of a floor panel according to a second embodiment of the invention.
Figure 5:
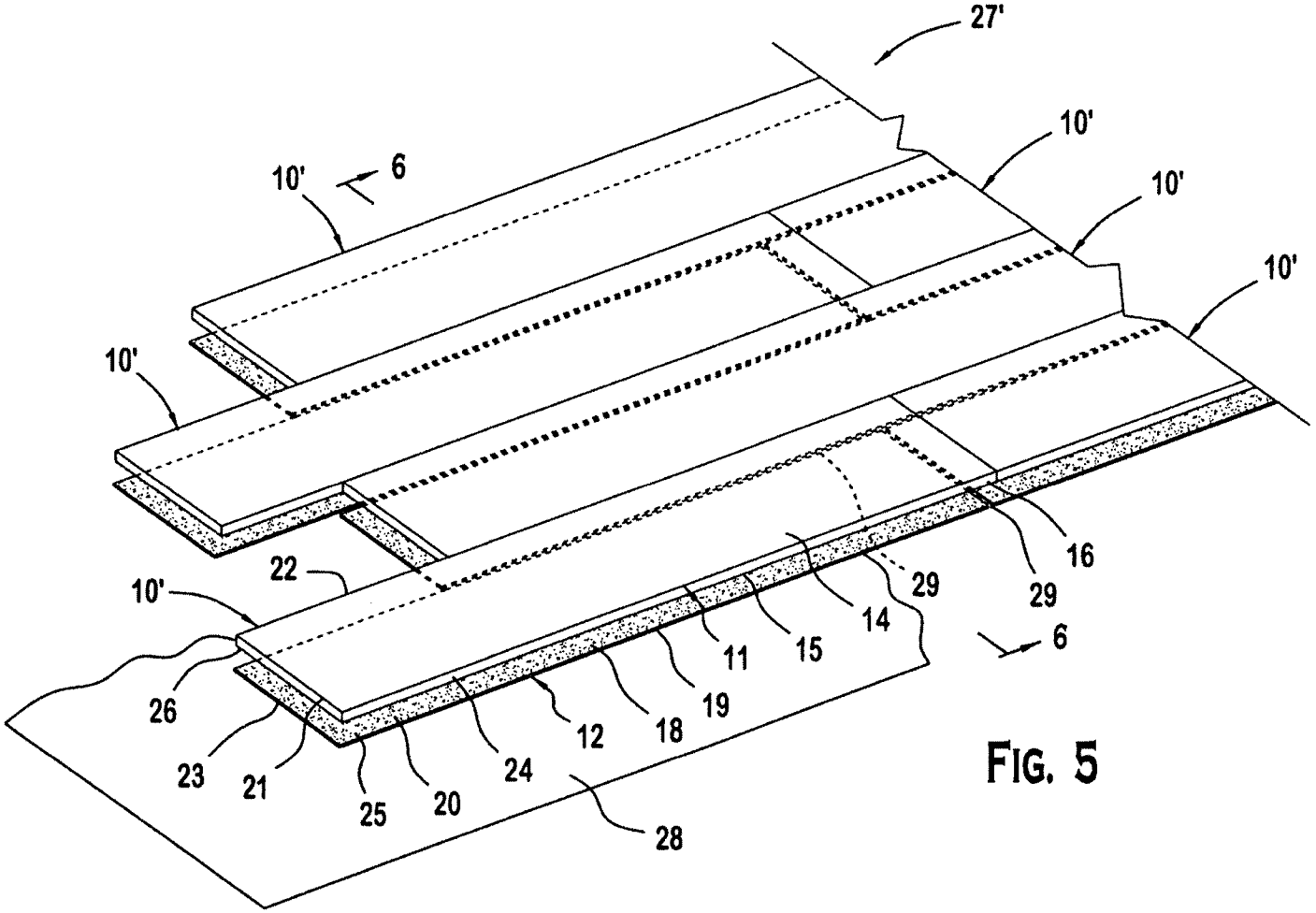
FIG. 5 is a perspective view of a floating floor system incorporating the floor panel of FIG. 4.
Figure 6:
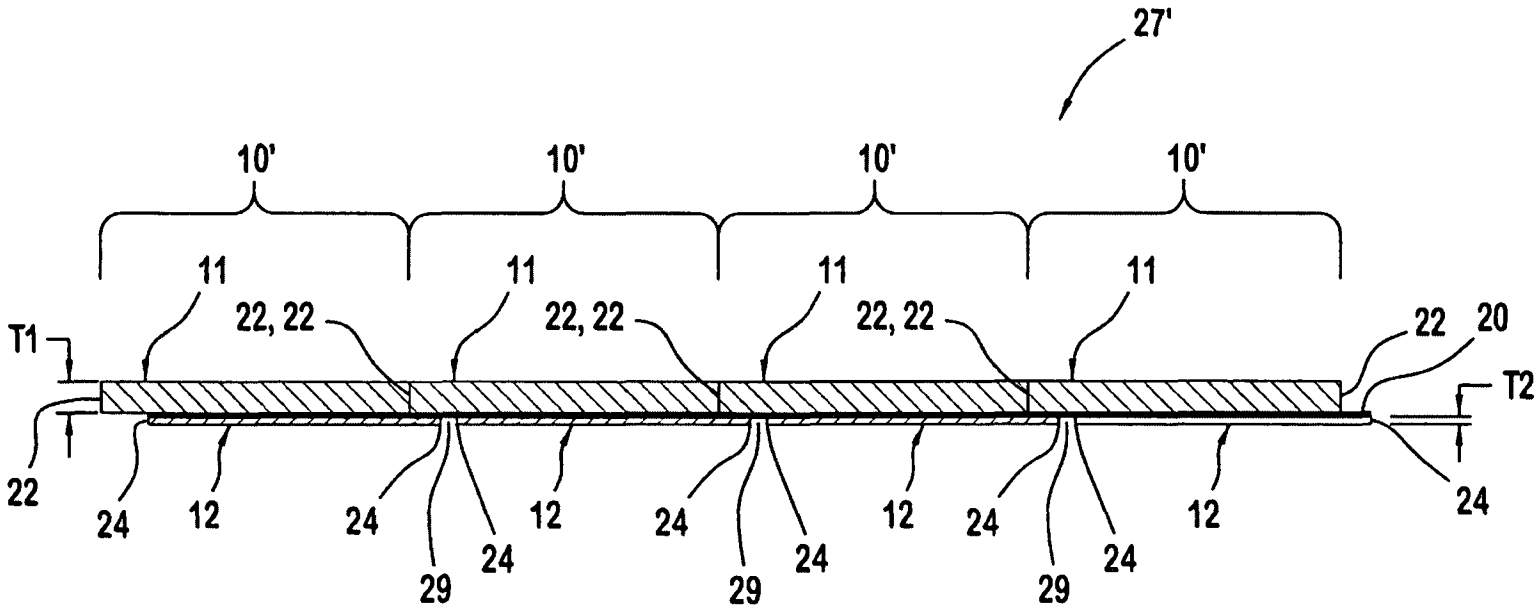
FIG. 6 is a sectional view taken along line 6-6 of FIG. 5.

FIGS. 4-6 show a floor panel 10' according to a second embodiment of the invention. As shown in FIG. 4, the floor panel 10' is identical to the floor panel 10 according to the first embodiment of the invention, except the bottom layer 12 has a length L2' and a width W2' smaller than the length L1 and the width W2 of the top layer 11. For example, in the illustrated embodiment, the length L2' of the bottom layer 12 is about 0.125 inches (0.3 centimeters) smaller than the length L1 of the top layer 11, and the width W2' of the bottom layer 12 is about 0.125 inches (0.3 centimeters) smaller than the width W1 of the top layer 11. It will be appreciated by those skilled in the art, however, that the length L2' and the width W2' of the bottom layer 12 may be varied to vary the dimensions of gap 29, as described in more detail below with reference to FIGS. 5-6.

As shown in FIG. 4, the top layer 11 is adhered to the bottom layer 12 so that the top layer 11 is offset from the bottom layer 12 in a direction of the length L1, L2' and the width W1, W2'. In other words, opposing first ends 21 of the top layer 11 are offset in the direction of the length L1, L2' from opposing first ends 23 of the bottom layer 12 an offset distance D1, D2', and opposing second ends 22 of the top layer 11 are offset in the direction of the width W1, W2' from opposing second ends 24 of the bottom layer 12 an offset distance D3, D4'. In the illustrated embodiment, the offset distances D1, D3, are, for example, about 1 inch (about 2.5 centimeters), and the offset distances D2', D4' are, for example, about 1.125 inches (about 2.8 centimeters).

FIGS. 5-6 show a floating floor system 27' comprising a plurality of the floor panels 10' installed on the sub-floor 28. The floor panels 10' are installed in the same way as the floor panels 10 according to the first embodiment of the invention, except the first ends 23 of the bottom layer 12 of the floor panels 10' are spaced from the first ends 23 of the bottom layer 12 of the adjacent floor panels 10', and the second ends 24 of the bottom layer 12 of the floor panels 10' are spaced from the second ends 24 of the bottom layer 12 of the adjacent floor panels 10' so the gap 29 is formed there between. In the illustrated embodiment, the gap 29 is about 0.125 inches (0.3 centimeters).

Because the thickness T2 of the bottom layer 12 of the floor panels 10' is smaller than the thickness T1 of the top layer 11, when the gap 29 is provided between the first and second ends 23, 24 of the bottom layers 12 of the adjacent floor panels 10', the gap 29 will not impact the aesthetic and/or structural characteristics of the top layer 11. Also, the size of any gaps occurring between the sub-floor 28 and the unsupported marginal end portions of the top layer 11 of a first row of the floor panels 10' is reduced. Therefore, by reducing the thickness of the bottom layer 12, buckling at the top surface 18 of the top layer 11 can be prevented. Additionally, because the bottom layer 12 does not comprise a mix layer and is formed of a moisture resistant material, the bottom layer 12 is capable of acting as a moisture barrier between the sub-floor 28 and the floor panel 10. Further, because the thickness T2 of the bottom layer 12 is smaller than the thickness T1 of the top layer 11, when the floor panels 10' are stacked, for example, during shipping, the distance between the unsupported marginal end portions of adjacent top layers 11 is decreased such that any bending and/or curling of the unsupported marginal end portions of the top layer 11 is reduced.

Figure 7:
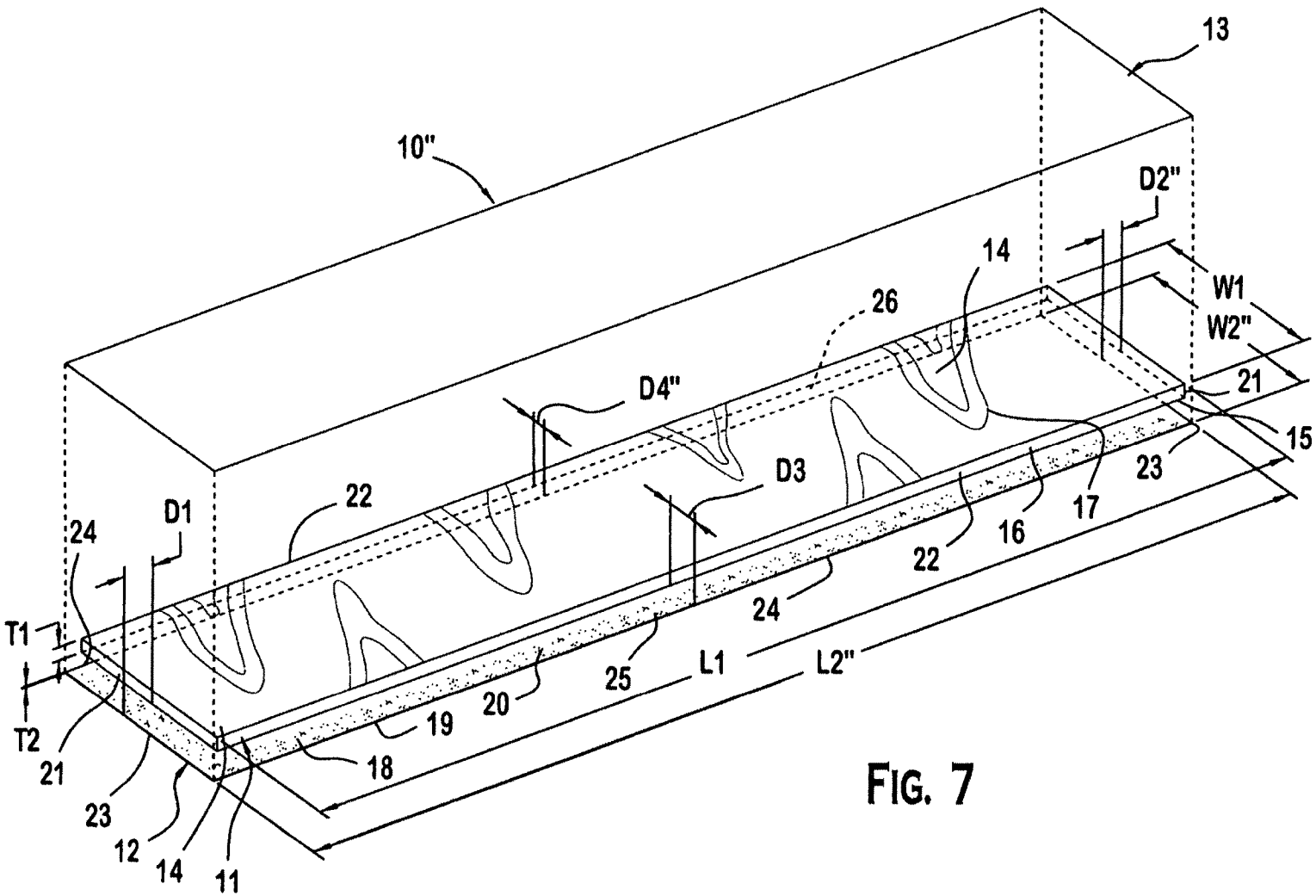
FIG. 7 is a partially exploded perspective view of a floor panel according to a third embodiment of the invention.
Figure 8:
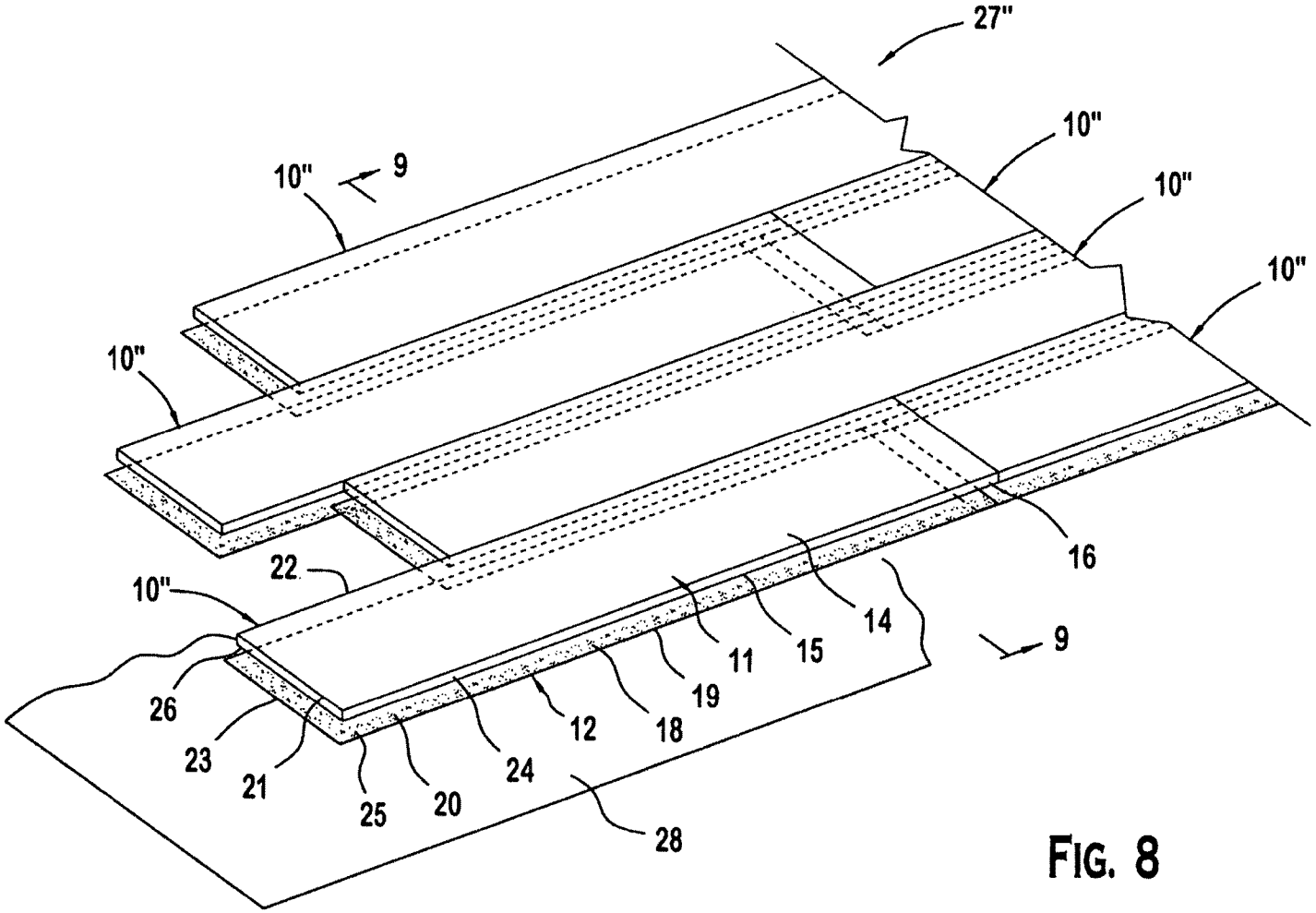
FIG. 8 is a perspective view of a floating floor system incorporating the floor panel of FIG. 7.
Figure 9:
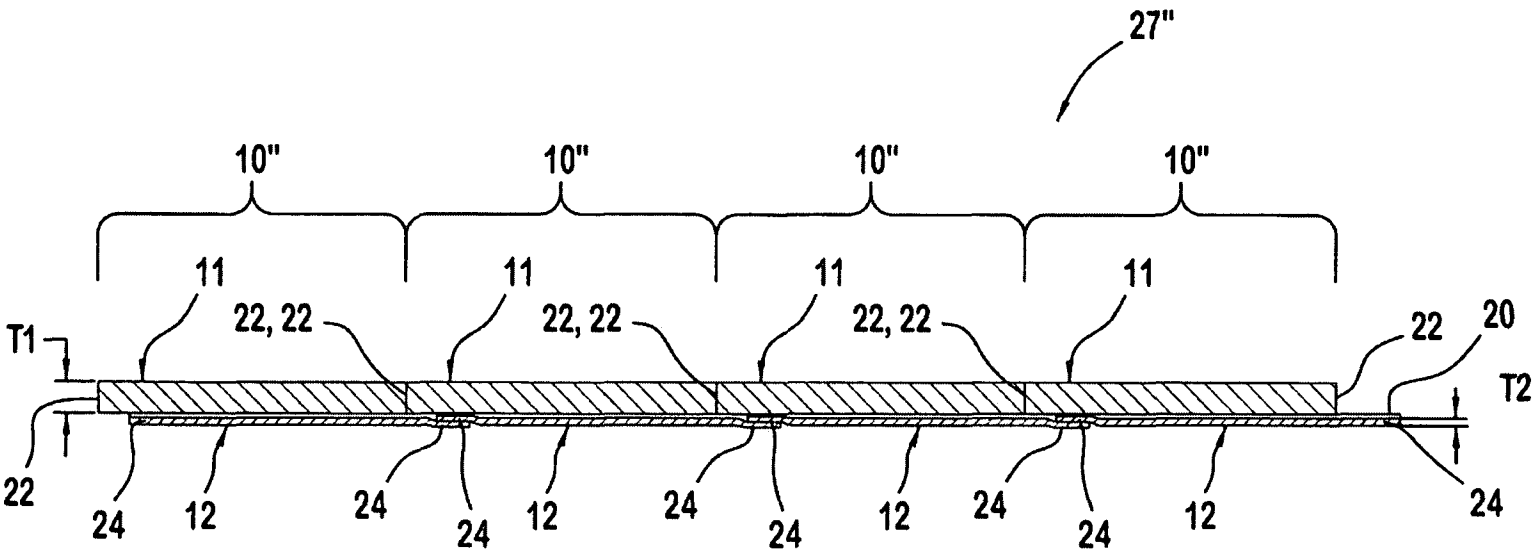
FIG. 9 is a sectional view taken along line 9-9 of FIG. 8.

FIGS. 7-9 show a floor panel 10" according to a third embodiment of the invention. As shown in FIG. 7, the floor panel 10" is identical to the floor panel 10 according to the first embodiment of the invention, except that the bottom layer 12 has a length L2" and a width W2" larger than the length L1 and the width W2 of the top layer 11. For example, in the illustrated embodiment, the length L2" of the bottom layer 12 is about 0.125 inches (0.3 centimeters) larger than the length L1 of the top layer 11, and the width W2" of the bottom layer 12 is about 0.125 inches (0.3 centimeters) larger than the width W1 of the top layer 11. It will be appreciated by those skilled in the art, however, that the length L2" and the width W2" of the bottom layer 12 may be varied to vary the amount of overlap, as described in more detail below with reference to FIGS. 8-9.

As shown in FIG. 7, the top layer 11 is adhered to the bottom layer 12 so that the top layer 11 is offset from the bottom layer 12 in a direction of the length L1, L2" and the width W1, W2". In other words, opposing first ends 21 of the top layer 11 are offset in the direction of the length L1, L2" from opposing first ends 23 of the bottom layer 12 an offset distance D1, D2", and opposing second ends 22 of the top layer 11 are offset in the direction of the width W1, W2" from opposing second ends 24 of the bottom layer 12 an offset distance D3, D4". In the illustrated embodiment, the offset distances D1, D3, are, for example, about 1 inch (about 2.5 centimeters), and the offset distances D2', D4' are, for example, about 0.875 inches (about 2.2 centimeters).

FIGS. 8-9 show a floating floor system 27" comprising a plurality of the floor panels 10" installed on the sub-floor 28. The floor panels 10" are installed in the same way as the floor panels 10 according to the first embodiment of the invention, except the first ends 23 of the bottom layer 12 of the floor panels 10" substantially overlap the first ends 23 of the bottom layer 12 of the adjacent floor panels 10", and the second ends 24 of the bottom layer 12 of the floor panels 10" substantially overlap the second ends 24 of the bottom layer 12 of the adjacent floor panels 10". The first and second ends 23, 24 of the bottom layer 12 overlap, for example, by about 0.125 inches (0.3 centimeters).

Because the thickness T2 of the bottom layer 12 of the floor panels 10" is smaller than the thickness T1 of the top layer 11, when the first and second ends 23, 24 of the bottom layers 12 of the adjacent floor panels 10" are overlapped, the overlap will not impact the aesthetic and/or structural characteristics of the top layer 11. Also, the size of any gaps occurring between the sub-floor 28 and the unsupported marginal end portions of the top layer 11 of a first row of the floor panels 10" is reduced. Therefore, by reducing the thickness of the bottom layer 12, buckling at the top surface 18 of the top layer 11 can be prevented. Additionally, because the first and second ends 23, 24 of the bottom layers 12 are overlapped, the bottom layer 12 is capable of providing a moisture barrier between the sub-floor 28 and the floor panel 10". Further, because the thickness T2 of the bottom layer 12 is smaller than the thickness T1 of the top layer 11, when the floor panels 10" are stacked, for example, during shipping, the distance between the unsupported marginal end portions of adjacent top layers 11 is decreased such that any bending and/or curling of the unsupported marginal end portions of the top layer 11 is reduced.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A floor panel for use in a floating floor, the floor panel comprising:

a top layer having a top surface and a bottom surface, the top surface having a visible decorative pattern;

a bottom layer having a top surface and a bottom surface;

the top surface of the bottom layer being adhered to the bottom surface of the top layer such that the bottom layer is offset from the top layer in a direction of length and width, thereby leaving both the top surface of a marginal end portion of the bottom layer and the bottom surface of a marginal end portion of the top layer exposed, and at least one of the marginal end portions having an adhesive, and a ratio of a thickness of the top layer to a thickness of the bottom layer is about 5 or greater; and a length and a width of the bottom layer is less than a length and a width of the top layer, creating a gap between the bottom layer of the floor panel and a bottom layer of an adjacent floor panel of the floating floor, whereby no adhesive is present in the gap that causes the floor panel to adhere to a sub-floor, thereby allowing the floor panel to float relative to the sub-floor.

2. The floor panel of claim 1, wherein the marginal end portions are substantially L-shaped.

3. The floor panel of claim 1, wherein the adhesive is a pressure sensitive acrylic adhesive.

4. The floor panel of claim 1, wherein the bottom layer is a moisture resistant film.

5. The floor panel of claim 1, further comprising a release member adjacent the adhesive.

6. The floor panel of claim 5, wherein the release member is separate from the bottom layer and the top layer.

7. The floor panel of claim 1, wherein the bottom layer is selected from a group consisting of at least one of a continuous or discontinuous ink layer, antimicrobial layer, sound deadening layer, cushioning layer, slide resistant layer, stiffening layer, channeling layer, mechanically embossed texture, and chemical texture.

8. The floor panel of claim 1, wherein a ratio of a thickness of the top layer to the thickness of the bottom layer is about 10-100.

9. The floor panel of claim 8, wherein the ratio of the thickness of the top layer to the thickness of the bottom layer is about 10-20.

10. The floor panel of claim 1, wherein a thickness of the bottom layer is about 1-60 mils.

11. The floor panel of claim 10, wherein the thickness of the bottom layer is about 6.5-12 mils.

12. The floor panel of claim 11, wherein the thickness of the bottom layer is about 8 mils.

13. The floor panel of claim 1, wherein the top layer comprises a mix layer and at least one layer selected from a group consisting of a mix layer, a print film, a wear layer, and a top coat.

14. The floor panel of claim 1, wherein the top layer is a substantially flexible sheet material.

15. The floor panel of claim 14, wherein the substantially flexible sheet material is selected from a group consisting of plastic, vinyl, polyvinyl chloride, and polyester.

16. The floor panel of claim 1, wherein the bottom layer is a film selected from a group consisting of plastic, vinyl, polyvinyl chloride, polyester, polyolefin, and nylon.

17. The floor panel of claim 1, wherein the bottom layer is a tape selected from a group consisting of plastic, vinyl, polyvinyl chloride, polyester, polyolefin, and nylon.

18. The floor panel of claim 1, wherein the bottom layer comprises multiple layers.

19. A floating floor system, comprising:

at least two adjacent floor panels, each of the floor panels comprising:

a top layer having a top surface and a bottom surface, the top surface having a visible decorative pattern;

a bottom layer having a top surface and a bottom surface;

the top surface of the bottom layer being adhered to the bottom surface of the top layer such that the bottom layer is offset from the top layer in a direction of length and width, thereby leaving both the top surface of a marginal end portion of the bottom layer and the bottom surface of a marginal end portion of the top layer exposed;

at least one of the marginal end portions having an adhesive; and the bottom surface of the marginal end portion of the bottom layer being adhered to the top surface of the marginal end portion of the top layer of the adjacent floor panel;

a length and a width of each bottom layer is less than a length and a width of each top layer, creating a gap between the bottom layer of a first panel and a bottom layer of a second adjacent panel of the floating floor, whereby the first and second adjacent floor panels are not adhered to a sub-floor by the adhesive, allowing the first and second adjacent floor panels to float relative to the sub-floor.

20. The floating floor system of claim 19, wherein the marginal end portions are substantially L-shaped.

21. The floating floor system of claim 19, wherein the adhesive is a pressure sensitive acrylic adhesive.

22. The floating floor system of claim 19, wherein the bottom layer is a moisture resistant film.

23. The floating floor system of claim 19, further comprising a release member adjacent the adhesive.

24. The floating floor system of claim 23, wherein the release member is separate from the bottom layer and the top layer.

25. The floating floor system of claim 19, wherein the bottom layer is selected from a group consisting of at least one of a continuous or discontinuous ink layer, antimicrobial layer, sound deadening layer, cushioning layer, slide resistant layer, stiffening layer, channeling layer, mechanically embossed texture, and chemical texture.

26. The floating floor system of claim 19, wherein a ratio of a thickness of the top layer to the thickness of the bottom layer is about 10-100.

27. The floating floor system of claim 26, wherein the ratio of the thickness of the top layer to the thickness of the bottom layer is about 10-20.

28. The floating floor system of claim 19, wherein a thickness of a bottom layer is about 1-60 mils.

29. The floating floor system of claim 28, wherein the thickness of the bottom layer is about 6.5-12 mils.

30. The floating floor system of claim 29, wherein the thickness of the bottom layer is about 8 mils.

31. The floating floor system of claim 19, wherein the top layer comprises a mix layer and at least one layer selected from the group consisting of a print film, a wear layer, and a top coat.

32. The floating floor system of claim 19, wherein the top layer is a substantially flexible sheet material.

33. The floating floor system of claim 32, wherein the substantially flexible sheet material is selected from a group consisting of plastic, vinyl, polyvinyl chloride, and polyester.

34. The floating floor system of claim 19, wherein the bottom layer is a film selected from a group consisting of plastic, vinyl, polyvinyl chloride, polyester, polyolefin, and nylon.

35. The floating floor system of claim 19, wherein the bottom layer is a tape selected from a group consisting of plastic, vinyl, polyvinyl chloride, polyester, polyolefin, and nylon.

36. The floating floor system of claim 19, wherein the bottom layer comprises multiple layers.

37. A floating floor system, comprising:

a plurality of floor panels, each of the plurality of floor panels comprising:

a top layer having a top surface and a bottom surface, the top surface having a visible decorative pattern;

a bottom layer having a top surface and a bottom surface, the top surface of the bottom layer having an adhesive applied thereto;

the top surface of the bottom layer adhered to the bottom surface of the top layer by the adhesive such that the bottom layer is offset from the top layer in a direction of length and width, thereby leaving both the top surface of a marginal end portion of the bottom layer and the bottom surface of a marginal end portion of the top layer exposed;

a length and a width of the bottom layer being less than a length and a width of the top layer;

the plurality of floor panels arranged atop a sub-floor so that the marginal end portion of the top layer of one of the plurality of floor panels overlies the marginal end portion of the bottom layer of an adjacent one of the plurality of floor panels such that the adhesive on the top surface of the marginal portion of the bottom layer of the adjacent one of the plurality of floor panels adheres the overlying marginal end portions together, the top layers of the one and the adjacent one of the plurality of floor panels abutting one another and a gap existing between the bottom layers of the one and the adjacent one of the plurality of floor panels; and wherein the plurality of floor panels are not adhered to the sub-floor by the adhesive, allowing the plurality of the floor panels to float relative to the sub-floor.

38. The floating floor system of claim 37 wherein for each of the plurality of floor panels, a ratio of a thickness of the top layer to a thickness of the bottom layer is about 5 or greater.

39. The floating floor system of claim 37 wherein no adhesive is present in the gap.

* * * * *